United States Patent [19]

Ashok et al.

[11] Patent Number: 4,971,133

[45] Date of Patent: Nov. 20, 1990

[54] METHOD TO REDUCE POROSITY IN A SPRAY CAST DEPOSIT

[75] Inventors: Sankaranaryanan Ashok, Bethany; William G. Watson, Cheshire; Brian Mravic; Harvey P. Cheskis, both of North Haven, all of Conn.

[73] Assignee: Olin Corporation, New Haven, Conn.

[21] Appl. No.: 332,183

[22] Filed: Apr. 3, 1989

[51] Int. Cl.[5] ..... B22D 23/00; B22D 11/06

[52] U.S. Cl. ..... 164/46

[58] Field of Search ..... 164/46, 271, 429

[56] References Cited

U.S. PATENT DOCUMENTS

| | | | |
|---|---|---|---|
| Re. 31,767 | 12/1984 | Brooks | 164/46 X |
| 3,775,156 | 11/1973 | Singer . | |
| 3,826,301 | 7/1974 | Brooks | 164/46 |
| 4,047,933 | 9/1977 | Larson et al. . | |
| 4,066,117 | 1/1978 | Clark et al. | 164/46 |
| 4,804,034 | 2/1989 | Leatham et al. | 164/46 |
| 4,901,784 | 2/1990 | Ashok et al. | 164/46 X |
| 4,907,639 | 3/1990 | Ashok et al. | 164/46 |
| 4,917,170 | 4/1990 | Ashok et al. | 164/46 X |
| 4,925,103 | 5/1990 | Muench et al. | 239/79 |
| 4,926,927 | 5/1990 | Watson et al. | 164/46 X |

FOREIGN PATENT DOCUMENTS 2172900 10/1986 United Kingdom .

OTHER PUBLICATIONS

Osprey Metal Ltd., "The Osprey Preform Process", published by Osprey Metals Ltd., Neath, West Glam. SA11 INJ United Kingdom.

L'Estrade L. et al., "Internal Porosity of Gas Atomized Powders", published by Hoogamas AB, Sweden, 1988.

*Primary Examiner*—Richard K. Seidel

*Assistant Examiner*—J. Reed Batten, Jr.

*Attorney, Agent, or Firm*—Gregory S. Rosenblatt; Paul Weinstein

[57] ABSTRACT

The average diameter of atomized droplets is reduced thereby reducing both the frequency of collisions between droplets as well as the turbulence at the liquid/-solid interface. Reducing the porosity of a spray cast deposit leads to improvements in both the ductility and the electrical conductivity of the deposit.

7 Claims, 2 Drawing Sheets

METHOD TO REDUCE POROSITY IN A SPRAY CAST DEPOSIT

This invention relates to metal alloys produced by spray casting. More particularly, the invention relates to a method for reducing the porosity of spray cast articles by increasing the atomization gas volume to metal mass ratio during spray casting.

Spray casting is a method to manufacture metal or metal alloy articles directly to a desired shape. The basic spray casting process comprises the steps of:

1. Atomizing a fine stream of molten metal.
2. Rapidly cooling the particles in flight so that the particles are either at or near the solidification temperature.
3. Depositing the particles on a collector. The collector is sometimes chilled to promote rapid solidification upon impact. Further, the collector moves in a predetermined pattern to generate a metal preform having a desired shape.
4. Optionally, working or directly machining the preform to generate the final shape and/or properties required.

This spray casting process is generally known as the OSPREY PROCESS and is more fully disclosed in U.S. Pat. Nos. Re 31,767 and 4,804,034 as well as United Kingdom Patent No. 2,172,900 A all assigned to Osprey Metals Limited of Neath, Wales. Further details about the process may be obtained from a publication entitled "The Osprey Preform Process" by Osprey Metals Ltd.

Spray cast products have many desirable properties. The articles are categorized by a fine microstructure, no macro-segregation and enhanced mechanical properties.

However, the density of the spray cast product is often low. To optimize the physical and electrical properties densities approaching 100% of the theoretical density of the alloy are desirable. The porosity of spray cast products may range to as high as 15% to 20% and densities of from about 90% to about 95% of theoretical are generally considered acceptable. Densities of about 98% theoretical and above are desirable but until now difficult to obtain.

Several schemes for improving the density of spray cast articles have been disclosed. U.S. Pat. No. Re 31,767 discloses subjecting the article to a subsequent densification process such as drop forging. U.S. Pat. No. 3,775,156 discloses passing a spray cast strip through a rolling mill to reduce porosity.

U.S. Pat. No. 4,047,933 discloses a process to reduce the porosity of metal powders by the addition of an activating agent to the metal alloy. The activating agent is selected to have an affinity for oxygen. An inert gas is used for atomization and the necessary oxygen is present as residual contamination. An oxide skin is formed on the surface of the particles.

Another process for improving the density of spray cast articles comprises supercooling the atomized droplets and increasing the kinetic energy imparted to the droplets. This process is disclosed in U.S. Pat. No. 4,066,117. The patent discloses the use of extremely cold (−168° C. to −193° C.) gas accelerated to supersonic speeds to impinge the molten stream to cause atomization.

A well known process somewhat related to spray casting is powder metallurgy. Unlike spray casting in which a coherent preform article is formed directly by the impact and consolidation of the atomized droplets on the collector plate, in powder metallurgy, a molten stream of metal is atomized. The atomized droplets are allowed to solidify. The solidified powder is collected and subsequently compacted into a desired shape by a combination of heat and pressure to enact sintering of the individual powder particles.

The amount of internal porosity of gas atomized powders has been found to be proportional to the particle size. An article entitled "Internal Porosity of Gas Atomized Particles" by L. L'Estrade et al. of HÖGANÄS AB, Sweden discloses that the internal porosity of gas atomized powders decreases as the particle size is reduced.

The present inventors have determined that the porosity of an article produced by spray casting may be reduced by limiting the collisions between particles and also reducing the turbulence at the interface between the collector and droplets.

Therefore, in accordance with the invention, the inventors have developed a method for the manufacture of shaped articles by spray casting in which the articles are characterized by lower porosity and higher density than achieved by conventional spray casting. It is a feature of the invention that this improvement in density is achieved without the need for subsequent mechanical working. It is a further feature of the invention that only minor modifications to the standard spray casting apparatus is required to achieve these benefits.

It is an advantage of the invention that the method produces shaped articles having improved ductility. It is a further advantage of the invention that the method produces shaped articles having improved physical and electrical properties.

Accordingly, there is provided a process for substantially reducing the porosity of a spray cast article. The process comprises the steps of melting an alloy having a desired composition and increasing the atomizing gas to metal ratio to reduce the frequency of collisions between droplets and to minimize turbulence at the collector/droplet interface. A collecting substrate is positioned an appropriate distance from the atomizer to collect the droplets. The droplets rapidly solidify to form a coherent shaped article.

Figure 1:
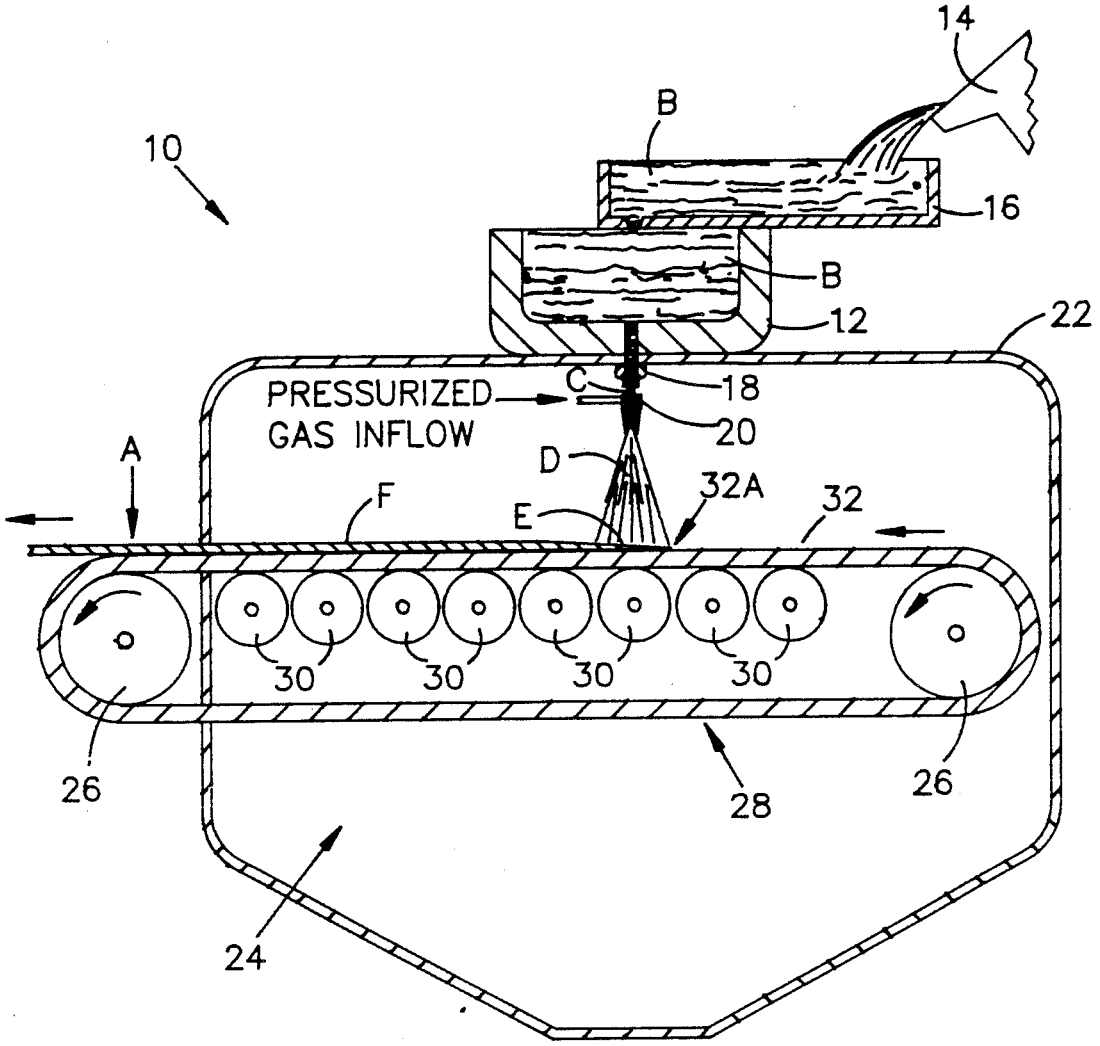
FIG. 1 illustrates a spray casting apparatus for the manufacture of a metal strip as employed for a method of the invention.

FIG. 1 illustrates a spray deposition apparatus 10 as known in the art. The system as illustrated produces a continuous strip of product A. The manufacture of discrete articles is also obtainable by changing the collecting surface as set forth in a second embodiment of the invention.

The spray deposition apparatus 10 employs a tundish 12 in which a metal alloy having a desired composition B is held in molten form. The tundish 12 receives the molten alloy B from a tiltable melt furnace 14, via a transfer launder 16. The tundish 12 further has a bottom nozzle 18 through which the molten alloy B issues in a continuous stream C. A gas atomizer 20 is positioned below the tundish bottom nozzle 18 within a spray chamber 22 of the apparatus 10.

The atomizer 20 is supplied with a gas under pressure from any suitable source. The gas serves to atomize the molten metal alloy and also supplies a protective atmosphere to prevent oxidation of the atomized droplets. The gas should preferably not react with the molten alloy. A most preferred gas is nitrogen. The nitrogen should have a low concentration of oxygen to avoid the formation of undesirable oxides. An oxygen concentration of under about 100 ppm and preferably less than about 10 ppm is desirable.

The atomization gas is impinged against the molten alloy stream under pressure producing droplets having a specific mean particle size. However, an empirical measurement of the pressure does not permit control of droplet size. As the diameter of the molten stream of metal increases, a given pressure of gas will supply proportionally less energy to break up the droplets. A more useful measurement of the effect of the impinging gas on the stream is the gas to metal ratio which is expressed in terms of cubic meters of gas per kilograms of metal.

Conventional spray casting operates at a gas to metal ratio of about 0.24 $m^3/kg$ to about 0.44 $m^3/kg$ and produces droplets having various diameters but predominantly in the range of from about 150 to about 250 microns.

The atomizer 20 surrounds the molten metal stream C and impinges the gas on the stream C so as to convert the stream into a spray D comprising a plurality of atomized molten droplets. The droplets are broadcast downward from the atomizer 20 in the form of a divergent conical pattern. If desired, more than one atomizer 20 may be used. The atomizer(s) 20 may be moved in a desired pattern for a more uniform distribution of the molten metal particles.

A continuous substrate system 24 as employed by the apparatus 10 extends into the spray chamber 22 in generally horizontal fashion and spaced in relation to the gas atomizer 20. The substrate system 24 includes a drive means comprising a pair of spaced rolls 26, an endless substrate 28 in the form of a flexible belt entrained about and extending between the spaced rolls 26 and a series of rollers 30 which underlie and support an upper run 32 of the endless substrate 28. An area 32A of the substrate upper run 32 directly underlies the divergent pattern of spray D. The area 32A receives a deposit E of the atomized metal particles to form the metal strip product A.

Figure 2:
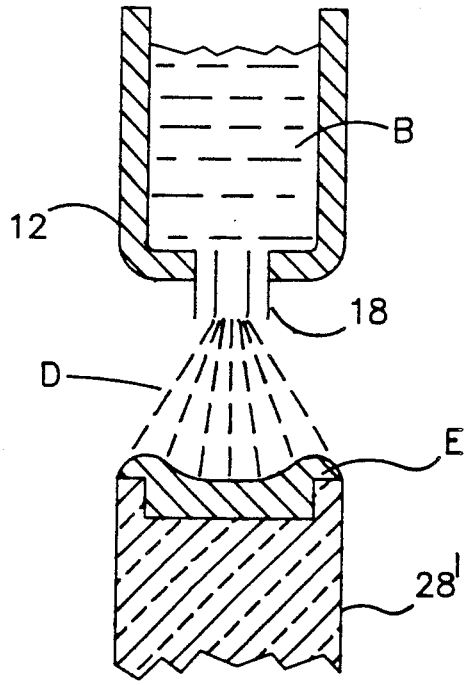
FIG. 2 illustrates a spray casting apparatus for the manufacture of a discrete metal article as employed for a method of the invention.

For certain applications, it may be desirable to form the alloy into a discrete article rather than a continuous strip. For these applications, the continuous substrate 28 is replaced with a collecting mold 28' as shown in FIG. 2. The system illustrated in FIG. 2 has been simplified by the removal of elements not required to differentiate FIG. 1. Elements performing similar functions to the elements of FIG. 1 have been designated with like reference numerals. The support elements of FIG. 1, such as furnace and spray chamber while not shown in FIG. 2 may be included in this embodiment and all other embodiments as well.

A divergent cone D of precursor droplets strikes the collecting mold 28'. The mold is shaped to form a desired article as disclosed in the above-cited U.S. Pat. No. Re 31,767 which is incorporated herein by reference. Any desired shaped article may be formed by the selection of a properly shaped mold.

Referring back to FIG. 1, the atomizing gas flowing from the atomizer 20 is much cooler than the molten metal B in the stream C. Thus, the impingement of atomizing gas on the spray particles during flight and the subsequent deposition on the substrate 28 extracts heat from the particles. The metal deposit E is cooled to below the solidus temperature of the alloy B forming a solid strip F which is carried from the spray chamber 22 by the substrate 28.

The droplets striking the collecting surface 28, 28' are preferably in a partially solidified state so that solidification is rapidly enacted upon impact with the collector. The collector is positioned a desired distance below the atomization point to be located at the region where most droplets are partially molten. The droplets are preferably at a temperature close to or below the solidification temperature upon impact. For conventional spray casting, the collector is generally positioned from about 500 millimeters to about 800 millimeters below the atomizer.

There are several theories relating to the origination of gas porosity in spray cast structures. A portion of the porosity is believed to originate from the droplets of molten metal. As the molten stream is atomized, a plurality of randomly shaped droplets are formed. The droplets have relatively low surface tension and retain random configurations. Frequently the droplets contain folds and extensions. Upon collision with other droplets, the folds collapse upon themselves forming a pocket containing trapped gas. When the droplets strike the collector and solidify, the entrapped gas forms a pore.

Another significant contribution to porosity is believed to originate at the liquid solid interface. Since some droplets are solid and some are liquid at the moment of impact with the collector surface, it is believed the interface between the droplets and the collecting surface is a highly viscous liquid region which rapidly solidifies. Droplets striking the interface create turbulence and drag gas below the surface. Some of the gas is entrapped by the rapidly advancing interface leading to porosity in the spray cast article. Reducing the interfacial turbulence will significantly reduce the porosity of the spray cast article.

It should be realized that when spray casting is initiated, the interface is located at the collecting substrate surface. As spray casting proceeds and metal is deposited upon the collecting substrate, the metal solidifies and the interface advances along the solidification front.

The inventors have developed a process to reduce the porosity of the spray cast article by reducing both the frequency of collisions between particles and by reducing the turbulence at the liquid/solid interface. By reducing the droplet size without significantly increasing the kinetic energy imparted to the droplets, the number of collisions may be reduced. For example, in copper alloy C510, a phosphor bronze having the nominal composition of 94.9% copper, 5% tin and 0.1% phosphorous, the porosity of a cast strip may be significantly reduced by reducing the average particle size from 150 microns to 250 microns to from about 44 microns to about 150 microns. Preferably, the particle size is as small as possible. However, it has been found that particles having a diameter of below about 44 microns solidify too rapidly and do not form a coherent article. Preferably, the average particle size is maintained between about 50 microns and about 75 microns.

The smaller particles are obtained by increasing the gas to metal ratio to from about 0.5 $m^3/kg$ to about 1.0 $m^3/kg$ and preferably from about 0.6 $m^3/kg$ to about 0.75 $m^3/kg$.

Since the particle size has been decreased without significantly increasing the kinetic energy imparted to the particles, turbulence at the liquid/solid interface is also reduced.

The smaller particles solidify more rapidly than larger particles because the droplets have a smaller volume of metal to cool and also have a proportionately larger surface area through which to radiate heat. The spaced relationship between the collector substrate and the atomizer must be adjusted accordingly. It is desirable to position the collecting surface so that the distance between the collecting surface and the pressurized gas source is such that the droplets are in a partially liquid state on impact with the collecting substrate. The droplets deform and weld together to form a coherent mass.

With copper based alloys, having a melting temperature of from about 1050° C. to about 1100° C. and a particle size in the range of from about 44 microns to about 150 microns, the optimum distance between collector substrate and atomizing source has been determined by the inventors to be from about 250 millimeters to about 500 millimeters and preferably from about 300 millimeters to about 400 millimeters.

While the invention has been described in terms of a specific copper alloy, the process is particularly suited for any copper based alloy such as the high performance copper alloys having high electrical conductivity (above about 50% IACS) and good ductility. Increasing the density of the copper based alloy leads to both improved ductility and higher electrical conductivity. An illustrative and by no means complete list of such alloys are copper alloy C151 (99.9% Cu, 0.1% Zr), copper alloy 194 (97.5% Cu, 2.35% Fe, 0.03% P and 0.12% Zn), copper alloy 195 (97% Cu, 1.5% Fe, 0.1% P, 0.8% Co and 0.6% Sn) and copper alloy 197 (99% Cu, 0.6% Fe, 0.2% P and 0.05% Mg).

Other copper based alloys as well as other metals and metal alloys, such as aluminum, nickel and iron based alloys are also significantly improved by the process of the invention.

The patents and publications set forth in the application are intended to be incorporated by reference.

It is apparent that there has been provided in accordance with this invention a method for the manufacture of spray cast alloys having improved ductility and higher density which fully satisfy the objects, means and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A process for substantially reducing the porosity of a spray cast alloy, comprising the steps of:

atomizing a molten stream consisting essentially of a desired metal alloy to droplets at an atomizing gas to molten metal ratio of from about 0.5 $m^3/kg$ to about 1.0 $m^3/kg$;

depositing said droplets on a collecting surface positioned an effective distance below the position where said molten stream is atomized such that said droplets are in a partially liquid state on impact with the collecting surface; and rapidly solidifying said droplets into a shaped article.

2. The process of claim 1 wherein said droplet size is controlled such that a substantial portion of said droplets have a diameter of from about 44 microns to about 150 microns.

3. The process of claim 2 wherein said droplet size is controlled such that a substantial portion of said droplets have a diameter of from about 50 microns to about 75 microns.

4. The process of claim 2 wherein said desired metal alloy is selected to be a copper based alloy.

5. The process of claim 4 wherein said ratio of atomizing gas to molten metal is from about 0.6 $m^3/kg$ to about 0.75 $m^3/kg$.

6. The process of claim 5 wherein said collector surface is positioned from about 250 millimeters to about 500 millimeters below the position where said molten stream is atomized.

7. The process of claim 6 wherein said collector surface is positioned from about 300 millimeters to about 400 millimeters below the position where said molten stream is atomized.

* * * * *